US011391176B2

(12) United States Patent
Johnson et al.

(10) Patent No.: US 11,391,176 B2
(45) Date of Patent: Jul. 19, 2022

(54) METHOD AND APPARATUS FOR SUPPLYING COOLING AIR TO A TURBINE

(71) Applicant: General Electric Company, Schenectady, NY (US)

(72) Inventors: Steven Douglas Johnson, Milford, OH (US); Nicholas R. Dinsmore, Marblehead, MA (US); Daniel Tyler Jarboe, West Chester, OH (US)

(73) Assignee: General Electric Company, Schenectady, NY (US)

( * ) Notice: Subject to any disclaimer, the term of this patent is extended or adjusted under 35 U.S.C. 154(b) by 55 days.

(21) Appl. No.: 16/715,706

(22) Filed: Dec. 16, 2019

(65) Prior Publication Data

US 2020/0157970 A1 May 21, 2020

Related U.S. Application Data

(63) Continuation of application No. 15/411,549, filed on Jan. 20, 2017, now Pat. No. 10,544,702.

(51) Int. Cl.

| | |
|---|---|
| ***F01D 25/12*** | (2006.01) |
| ***F01D 11/02*** | (2006.01) |
| ***F01D 9/04*** | (2006.01) |
| ***F01D 9/06*** | (2006.01) |
| ***F01D 11/06*** | (2006.01) |
| ***F01D 11/00*** | (2006.01) |

(52) U.S. Cl.

CPC ..... *F01D 25/12* (2013.01); *F01D 9/041* (2013.01); *F01D 9/065* (2013.01); *F01D 11/001* (2013.01); *F01D 11/02* (2013.01); *F01D 11/06* (2013.01); *F05D 2220/32* (2013.01); *F05D 2240/55* (2013.01); *F05D 2260/20* (2013.01); *F05D 2260/60* (2013.01)

(58) Field of Classification Search

CPC ..... F01D 11/001; F01D 11/02; F01D 11/06; F01D 9/06; F01D 9/065; F01D 9/041; F01D 25/12; F05D 2220/32; F05D 2240/55; F05D 2260/20; F05D 2260/60; F02C 7/12

See application file for complete search history.

(56) References Cited

U.S. PATENT DOCUMENTS

| | | | | |
|---|---|---|---|---|
| 2,988,325 | A * | 6/1961 | Dawson | F01D 5/081 415/110 |
| 4,820,116 | A * | 4/1989 | Hovan | F01D 1/32 415/115 |
| 5,232,335 | A * | 8/1993 | Narayana | F01D 5/081 415/115 |
| 6,884,023 | B2 | 4/2005 | Dube et al. | |
| 7,017,349 | B2 * | 3/2006 | Laurello | F01D 5/081 60/782 |
| 7,070,386 | B2 * | 7/2006 | Kessler | F01D 5/189 415/115 |
| 8,517,666 | B2 | 8/2013 | Alvanos et al. | |

(Continued)

*Primary Examiner* — Brian P Wolcott

(74) *Attorney, Agent, or Firm* — Dority & Manning, P.A.

(57) ABSTRACT

A gas turbine engine that includes a turbine interstage region. The turbine interstage region is configured to conduct bore bleed air outwardly. The interstage region includes a central plenum. The interstage region also includes a first mid-seal and a second mid-seal. The central plenum is fluidly connected to bore bleed air by a flow circuit that passes between the first mid-seal and the second mid-seal.

18 Claims, 7 Drawing Sheets

(56) References Cited

U.S. PATENT DOCUMENTS

| | | | | |
|---|---|---|---|---|
| 8,740,554 | B2 * | 6/2014 | Virkler | F01D 1/10 415/173.7 |
| 9,091,173 | B2 * | 7/2015 | Mosley | F01D 5/082 |
| 9,145,771 | B2 * | 9/2015 | Malmborg | F04D 29/053 |
| 9,303,526 | B2 | 4/2016 | Chir et al. | |
| 2015/0096304 | A1 * | 4/2015 | von der Esch | F02C 7/20 60/796 |

* cited by examiner

METHOD AND APPARATUS FOR SUPPLYING COOLING AIR TO A TURBINE

BACKGROUND OF THE INVENTION

The present invention relates to gas turbine engines and more specifically to cooling turbine sections of turbomachinery.

A gas turbine engine includes, in serial flow communication, a compressor, a combustor, and a turbine. The turbine is mechanically coupled to the compressor and together the three components define a turbomachinery core. The core is operable to generate a flow of hot, pressurized combustion gases. The core forms the basis for several aircraft engine types such as turbojets, turboprops, and turbofans.

In some conventional gas turbine engines, cooling of components such as the outer band of the high-pressure turbine is accomplished by conveying intermediate-stage compressor air to the areas to be cooled using pipes. A problem with conventional turbine engines is that the pipes add weight to the engine and occupy space which could be otherwise used. Therefore, there is a need for a structure that is configured to provide cooling air from the compressor to the turbine in a gas turbine engine without pipes.

BRIEF DESCRIPTION OF THE INVENTION

This need is addressed by a secondary bore bleed air circuit extending from the compressor rotor, through an axial air duct, between two turbine mid-seals, to a central plenum.

According to one aspect of the present invention, there is provided a gas turbine engine that includes a turbine interstage region. The turbine interstage region is configured to conduct bore bleed air outwardly. The interstage region includes a central plenum. The interstage region also includes a first mid-seal and a second mid-seal. The central plenum is fluidly connected to bore bleed air by a flow circuit that passes between the first mid-seal and the second mid-seal.

According to another aspect of the present invention there is provided a method for supplying cooling air to a turbine in a gas turbine engine. The method includes a step of conveying the cooling air radially outward along a circuit defined between a first disk and a second disk.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
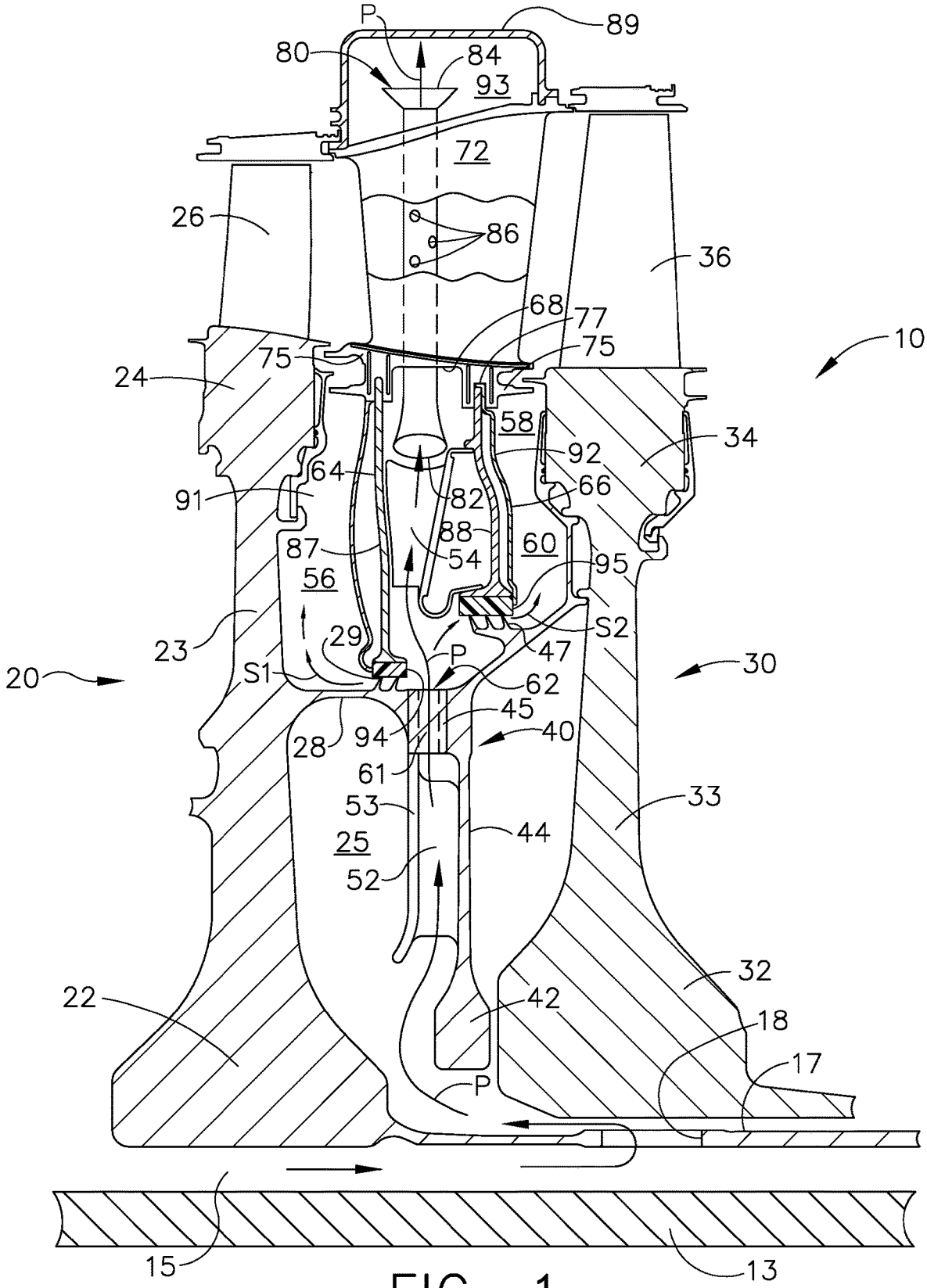
FIG. 1 is a sectional view with partial cutaways of an interstage region between a forward disk and an aft disk within a high-pressure turbine of a gas turbine engine wherein the interstage region is configured to conduct flow radially outward from an air duct to a central plenum.

Referring to the drawings wherein identical reference numerals denote the same elements throughout the various views, FIG. 1 depicts a sectional view of an annular interstage region 10 of a gas turbine engine 9. The interstage region 10 includes elements that are bodies of revolution extending around an axis 2 of the engine 9 and multiple individual elements that are radially distributed around the axis 2. The interstage region 10 is configured to define a cooling circuit P that is defined by a combination of bodies of revolution and radially distributed elements. Interstage region 10 is described below with reference to an exemplary section(s) in which portions of bodies of revolution and individual examples of radially distributed elements are shown.

The circuit P fluidly connects a plurality of inner core air ducts 15 that are configured to transfer bore bleed air with an outer band plenum 93 defined in an outer band 89. In this manner, the outer band 89 of the gas turbine engine 9 can be cooled with gases that flow radially outward within the turbine engine 9. Thus, piping conventionally used to conduct gases from a compressor section to the outer band is avoided. While the illustrated example is a high-bypass turbofan engine, the principles of the present invention are also applicable to other types of engines, such as low-bypass turbofans, turbojets, turboprops, etc.

The engine 9 has a longitudinal center line or axis 2. As used herein, the terms "axial" and "longitudinal" both refer to a direction parallel to the centerline axis 2, while "radial" refers to a direction perpendicular to the axial direction, and "tangential" or "circumferential" refers to a direction mutually orthogonal to the axial and radial directions. As used herein: the terms "forward" or "front" refer to a location relatively upstream in an air flow passing through or around a component; the terms "aft" or "rear" refer to a location relatively downstream in an air flow passing through or around a component; the terms "inner" and "radially inward" refer to locations relatively closer to the axis; and the terms "outer" and "radially outward" refer to locations relatively further from the axis. The direction of this flow is shown by the arrow "F" in FIG. 3. These directional terms are used merely for convenience in description and do not require a particular orientation of the structures described thereby.

Figure 2:
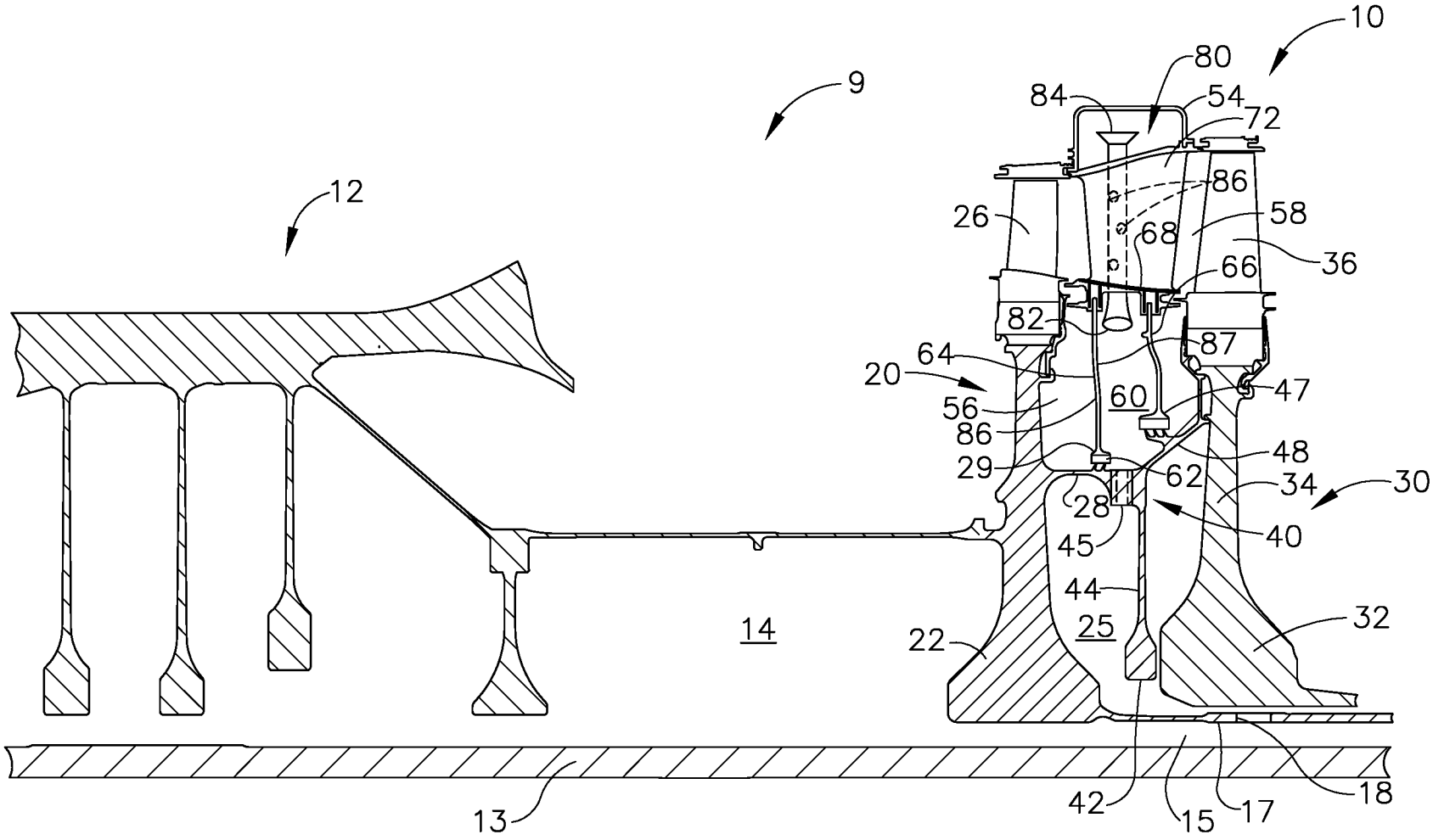
FIG. 2 is a sectional view with partial cutaways of a compressor and a high-pressure turbine in a gas turbine engine.
Figure 3:
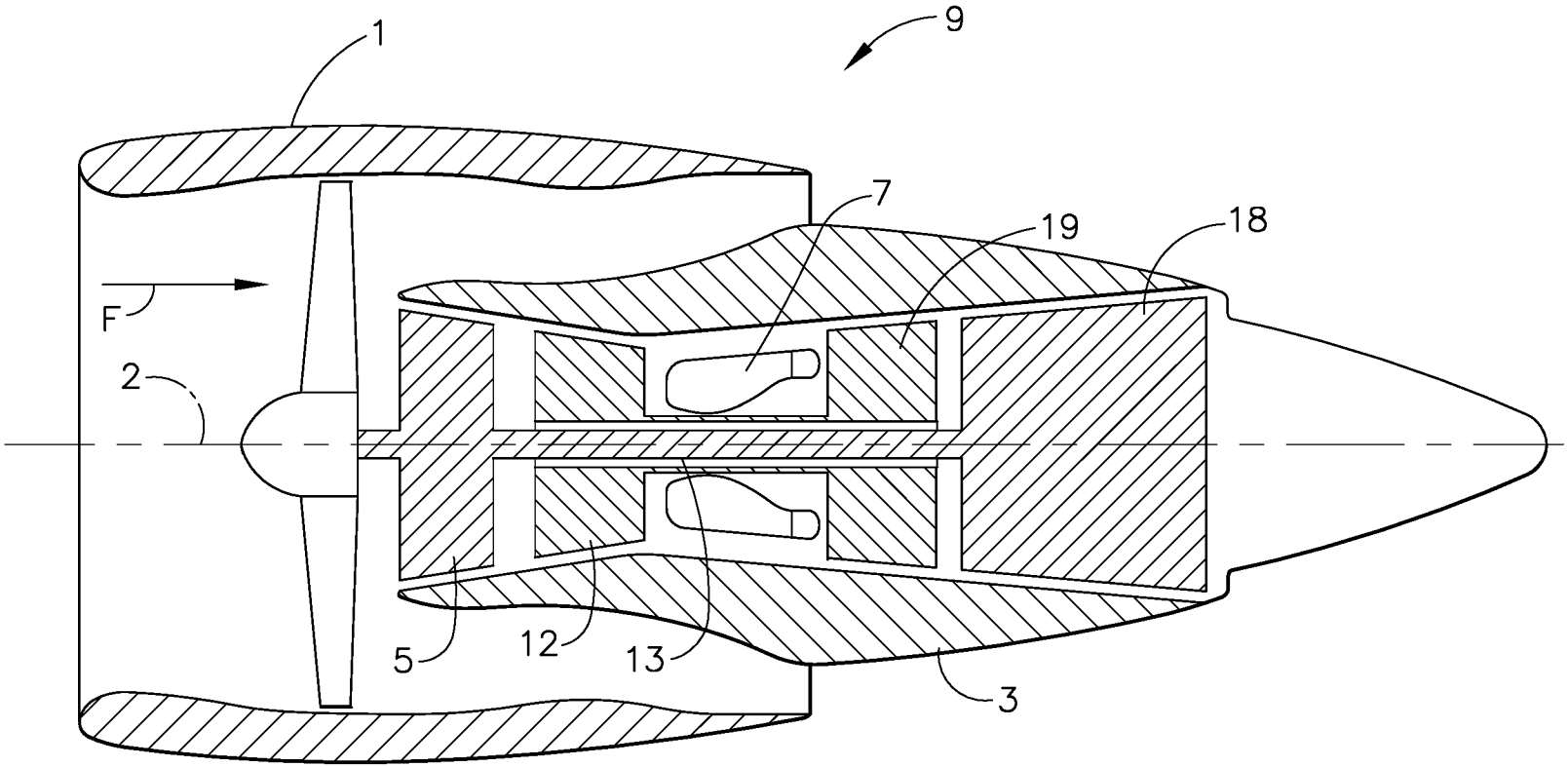
FIG. 3 is a schematic view of a conventional gas turbine engine.

Referring now to FIGS. 2 and 3, the engine 9 includes a fan nacelle 1 that is disposed concentrically about and coaxially along the axis 2. The fan nacelle 1 is configured to house an inner core 3 such that the inner core 3 and the fan nacelle 1 share the axis 2. A fan 4 is positioned within the fan nacelle 1 such that it is forward of the inner core 3. A booster 5, a compressor 12, a combustor 7, a high-pressure turbine 19, and a low-pressure turbine 8 are positioned within the inner core 3. The fan 4, the booster 5, the compressor 12, the combustor 7, the high-pressure turbine 19, and the low-pressure turbine 8 are arranged in serial flow relationship.

A shaft 13 extends between the compressor 12 and the high-pressure turbine 19 such that they are mechanically connected. As seen in FIG. 2, a chamber 14 is defined aft of the compressor 12 and forward of the high-pressure turbine 19.

Referring now to FIG. 1, the interstage region 10 is generally defined by a first stage disk 20 and a second stage disk 30. The first stage disk 20 and the second stage disk 30 are bodies of revolution. The first stage disk 20 and the second stage disk 30 in part define an annular inner chamber 25. The plurality of air ducts 15, each defined within an associated rotating tube, extends from the chamber 14, as shown in FIG. 2, to an inner chamber 25 of the interstage region 10 such that the chamber 14 and the interstage region 10 are fluidly connected. For each of the air ducts 15, an associated opening 18 is defined through a wall 17 that separates that air duct 15 from the inner chamber 25.

The first stage disk 20 includes a first stage disk bore 22 and a first stage disk web 23 that extends to a rim 24. A plurality of radially disposed first stage blades 26 extends outwardly from the rim 24. An aft arm 28, which is an annular ridge defined on the first stage disk web 23 about the axis 2, extends from the web 23 aft of the first stage disk 20. A forward mid-seal 29 is positioned at the aft edge of the aft arm 28. The forward mid-seal 29, as shown, is configured as a two-tooth labyrinth seal. The second stage disk 30 includes a bore 32, a web 33 that extends radially outward from the disk bore 32, and a rim 34. The second stage disk rim 34 is configured to support a plurality of radially disposed second stage blades 36.

A plurality of second stage nozzle vanes 72 are radially distributed outwardly of the central plenum 60 such that the second stage nozzle vanes 72 are aft of the first stage blades 26 and forward of the second stage blades 36. The plurality of second stage nozzle vanes 72 are supported by an inner band 73. A forward hanger 75 is defined on the inner band 73 and extends radially inward. An aft hanger 77 is defined on the inner band 73 and extends radially inward.

A forward stator plate 87 is a body of revolution that is attached to forward hanger 75. The forward stator plate 87 extends radially inward from the forward hanger 75 to a forward honeycomb block 94 attached thereto. An aft stator plate 88 is a body of revolution that is attached to the aft hanger 77. The aft stator plate 88 extends radially inward from the aft hanger 77 to an aft honeycomb block 95 attached thereto. The forward stator plate 87 extends closer to the axis 2 than does the aft stator plate 88.

A mid-seal disk 40 is positioned between the first stage disk 20 and the second stage disk 30. The mid-seal disk 40 is a body of revolution and includes a bore 42, a web 44, and a curvic 45. The curvic 45 is configured to mechanically link the mid-seal disk 40 with the first stage disk 20 via the aft arm 28 of the first stage disk 20. A plurality of curvic passageways 61 are defined through the curvic 45 between a radially inward side and a radially outward side of the curvic 45. An annular aft seal 47 is defined on the mid-seal disk 40. The seal 47, as shown, is configured as a three-tooth labyrinth seal in FIG. 1. It should be appreciated that the seals 29 and 47 can be configured as other types of rotating seals.

The forward mid-seal 29 and the aft mid-seal 47 are configured to sealingly engage the forward honeycomb block 24 and the aft honeycomb block 95 respectively and are positioned closer to the axis than conventional misdeals are. Stated another way, the method-seal disk 40 is of lower diameter than if the forward mid-seal 29 and the aft mid-seal 47 are positioned outwardly closer to the nozzle and 72. As a result, the potential leakage area across the forward to seal 29 in the aft seal 47 are lower than the potential leakage area in conventional seals.

An annular central plenum 60 is defined radially outward of the curvic 45. The central plenum 60 is defined by an inner boundary element 62, a forward boundary element 64, an aft boundary element 66, and an outer boundary element 68. A plurality of radial diffuser vanes 54 is positioned within the central plenum 60 between the forward boundary element 64 and the aft boundary element 66. The forward boundary element 64 is configured to separate the central plenum 60 from an annular forward chamber 56. The aft boundary element 66 is configured to separate the central plenum 60 from an annular aft chamber 58. A forward rotating plate 53 supports a plurality of impeller vanes 52 that are configured to prevent air from being pumped radially outward.

A transfer pipe 80 passes through at least one of the second stage nozzle vanes 72. The transfer pipe 80 extends from a trumpet 82 that is positioned within the central plenum 60 at one end to a diffuser 84 at another end. The diffuser 84 is positioned within an annular outer band plenum 93 that is defined in part by the outer band wall 89. A plurality of feed holes 86 are defined within the walls of beach transfer pipe 80. The feed holes 86 are configured to conduct cooling gas into the associated vane 72 as will be discussed further below. According to the illustrated embodiment, a transfer pipe 80 is associated with all of the radially distributed second stage nozzle vanes 72.

In the illustrated embodiment as shown in FIG. 1, the forward boundary element 64 is defined by the forward stator plate 87. A forward heatshield 91 is positioned forward of the stator plate 87. The aft boundary element 66 is defined by the aft stator plate 88. A heatshield 92 is positioned aft of the stator plate 88. It should be appreciated that the forward stator plate 87, the forward heatshield 91, the aft stator plate 88, and the heatshield 92 are all bodies of revolution.

Flow circuits between the air duct 15 that extend outwardly through the interstage region 10 will now be described. A primary flow circuit P extends from the air duct 15 through the opening 18 and into the chamber 25. Once in the chamber 25 the primary flow circuit P passes through the plurality of impeller vanes 52 and through the plurality of curvic passageways 61 defined through the curvic 45. After passing through the curvic passageways 61, the flow circuit P enters the central plenum 60.

Figure 4:
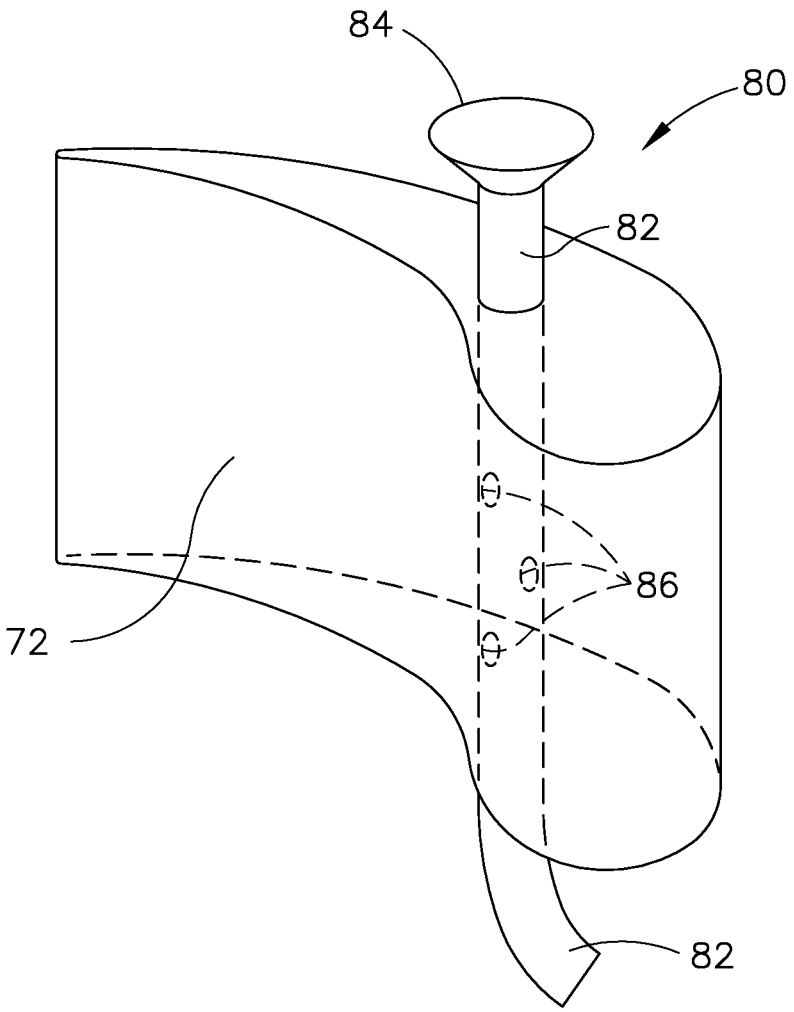
FIG. 4 is a perspective view of a second stage nozzle vane.

The flow circuit P exits the central plenum 60 by entering at least one of the pipes 80 after passing between the plurality of radial diffuser vanes 54. The plurality of radial diffuser vanes 54 is positioned to direct the gas flow into the pipe(s) 80 while increasing the static pressure of the gas. Correspondingly, the trumpet portion 82 of pipes 80 is oriented to intake gas via flow circuit P to minimize pressure loss and capture some of the dynamic head of the gas. As shown in FIG. 4, the trumpet 82 of the pipe 80 in the illustrated embodiment is oriented at an angle of about 45° angle relative to the nozzle 72. In addition, the trumpet 82 is turned to face an incoming flow, i.e. the highest total pressure at the trumpet 82 inlet. In other embodiments, the trumpet 82 can be oriented at different angles relative to the pipe 80.

A forward secondary flow circuit S1 is configured to conduct gas flow from the plenum 60 to the forward chamber 56 via the forward mid-seal 29. The flow circuit S1 continues radially outward away from the axis 2 to maintain a positive purge flow rate preventing high-temperature gases from entering the forward chamber 56.

An aft secondary circuit S2 is configured to conduct gas flow from the central plenum 60 into the aft chamber 58 via the aft mid-seal 47. The flow circuit S2 continues radially outward away from the axis 2 to maintain a positive purge flow rate preventing high temperature gases from passing inwardly into the aft chamber 58.

The structure described above can be better understood through a description of the operation thereof based on a section of the interstage region 10. Gases are generated such that the chamber 14 is at a pressure such that gas flow is generally radially outward from chamber 14 to the outer band plenum 93. Thus, gases are conducted through the air duct 15 and into the inner chamber 25 along the flow circuit P. The plurality of impeller vanes 52 act to increase the total pressure of the gas of flow circuit P through the passages 61 defined in the curvic 45 into the central plenum 60.

Pressure within the central plenum 60 acts to press forward on the forward stator plate 87 and aft on the aft stator plate 88. Because the aft midseal 47 is located further radially outward than the forward midseal 29, the aft stator plate is of less area than the forward stator plate 87. As a result, the pressure within the central plenum 60 applies a net load forward against the larger forward plate 87. The net result is that the aft axial load on the stator plates is reduced. Such a reduction in axial load allows for the stator plates to be of sufficient size for the forward midseal 29 and the aft midseal 47 to be positioned at the radially inward location.

The flow circuit P crosses through the plurality of radial diffuser vanes 54 which convert some of the dynamic head of the gas into an increase in static pressure. The diffuser 54 directs flow circuit P into the trumpet 82 of the pipe 80. In this manner, gases traveling along the flow circuit P are directed into the pipe 80. As the gases travel along flow circuit P through the pipe 80, some portion of the gases therein exit the pipe 80 through the feed holes 86. Gas that passes through the feed holes 86 enters a space defined within the vane 72 that is operable to cool the vane 72. Gases within the vane 72 exit cooling holes or slots (not shown). The remainder of gases traveling along the flow circuit P pass through the pipe 80 and exit the diffuser end 84.

It should be appreciated that not all of the gases of flow circuit P enter the transfer pipe 80. In this regard, once in the central plenum 60 some of the gases separate from the flow circuit P to continue on the secondary circuits S1 and S2. The secondary circuit S1 extends through the mid-seal 29 and into the forward chamber 56 such that the forward chamber 56 and the central plenum 60 are fluidly connected. The engine 9 is configured such that the secondary cooling gas flow rate entering chamber 56 through mid-seal 29 is sufficient to prevent hot gases from traveling radially inward from the primary flowpath into the forward chamber 56. The pressure within the central plenum 60 is greater than the pressure within the forward chamber 56.

Circuit S2 extends through the aft mid-seal 47 and into the aft chamber 58 such that the aft chamber 58 and the central plenum 60 are fluidly connected. The engine 9 is configured such that the secondary cooling gas flow rate entering chamber 58 through mid-seal 47 is sufficient to prevent hot primary flowpath gases from traveling radially inward into the aft chamber 58. The gas pressure within the central plenum 60 is greater than the pressure within the aft chamber 58.

Figure 5:
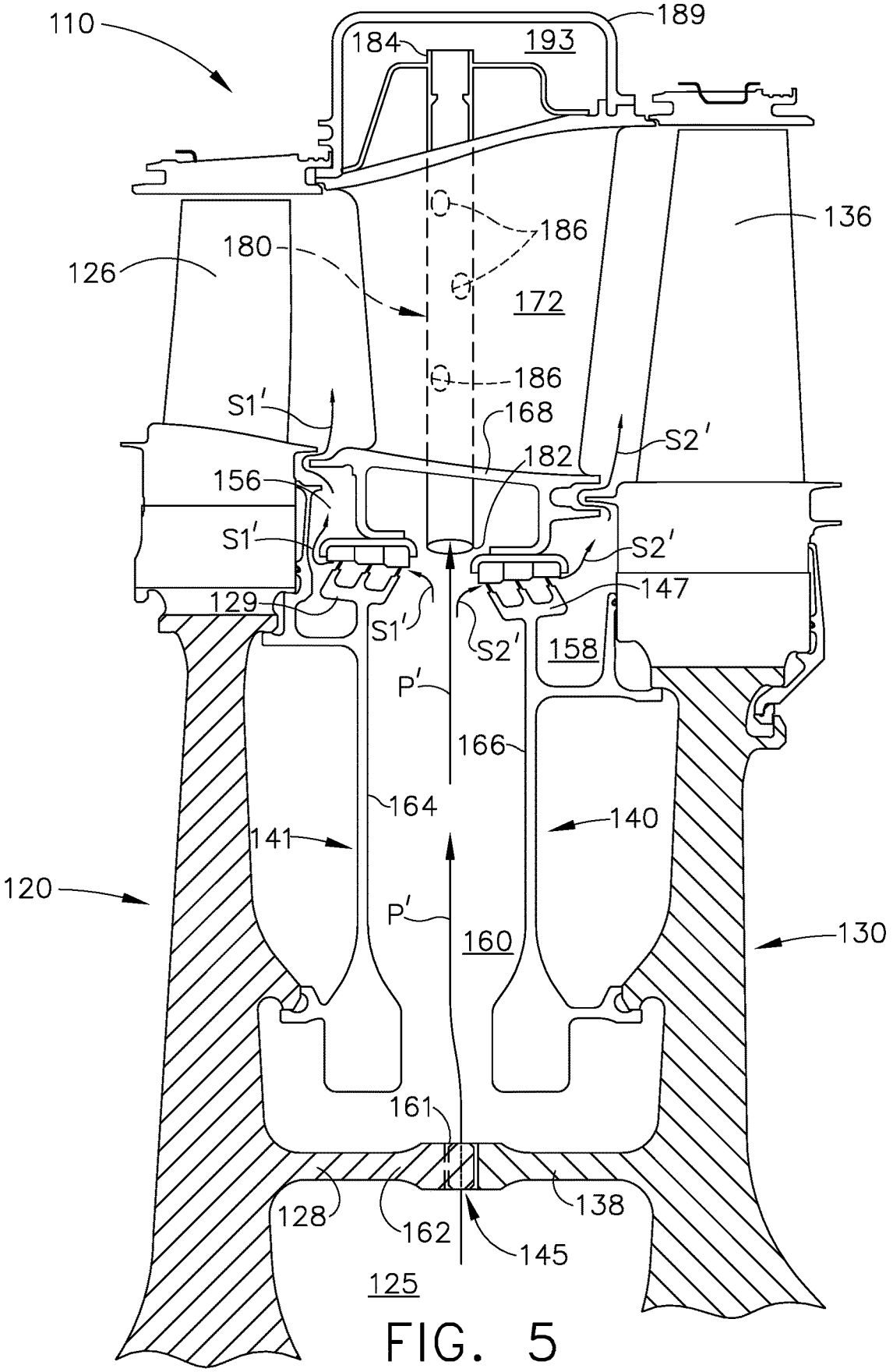
FIG. 5 is a sectional view with partial cutaways of an interstage region of a gas turbine engine according to an alternative embodiment of the present invention.
Figure 6:
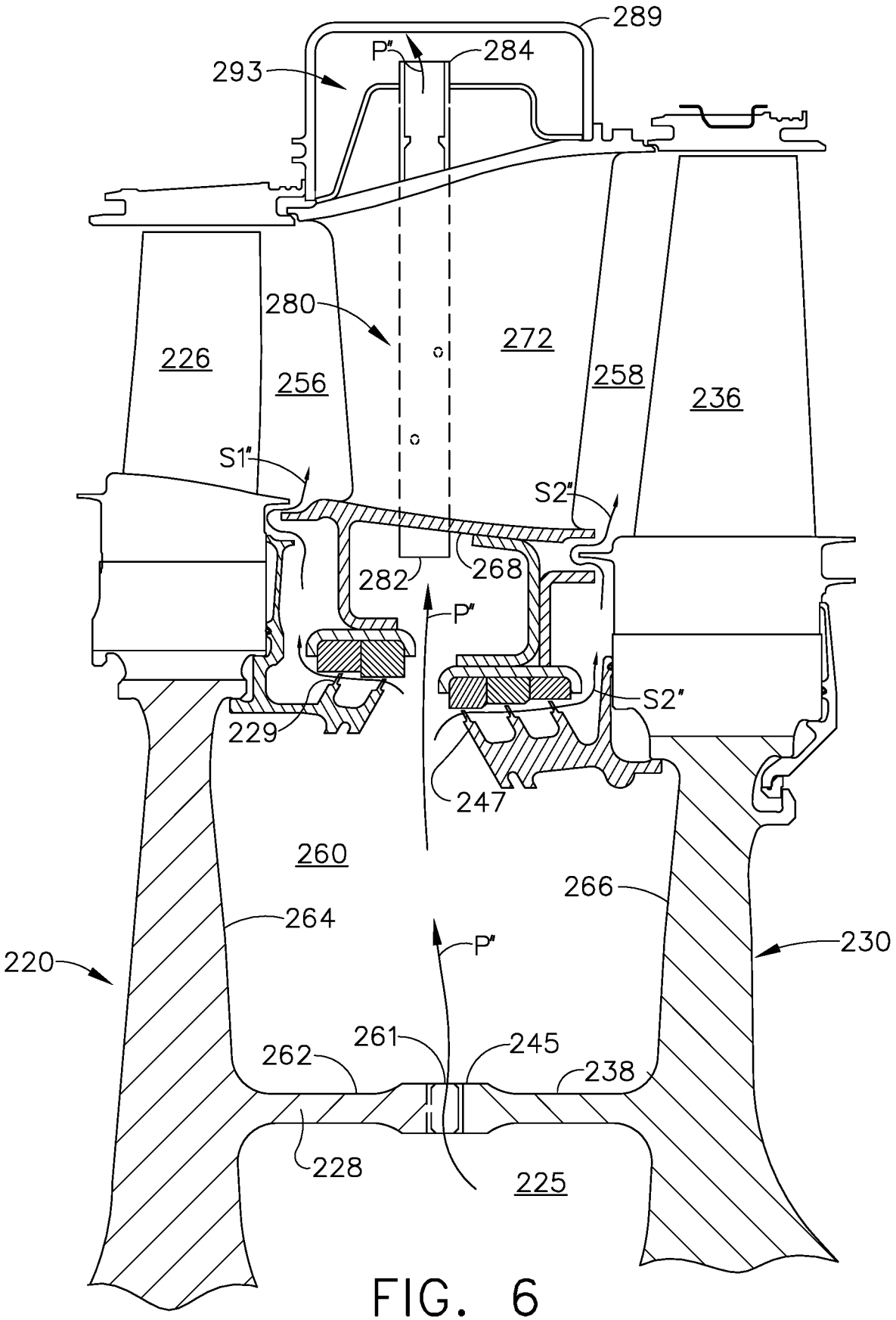
FIG. 6 is a sectional view with partial cutaways of an interstage region of a gas turbine engine according to another alternative embodiment of the present invention.
Figure 7:
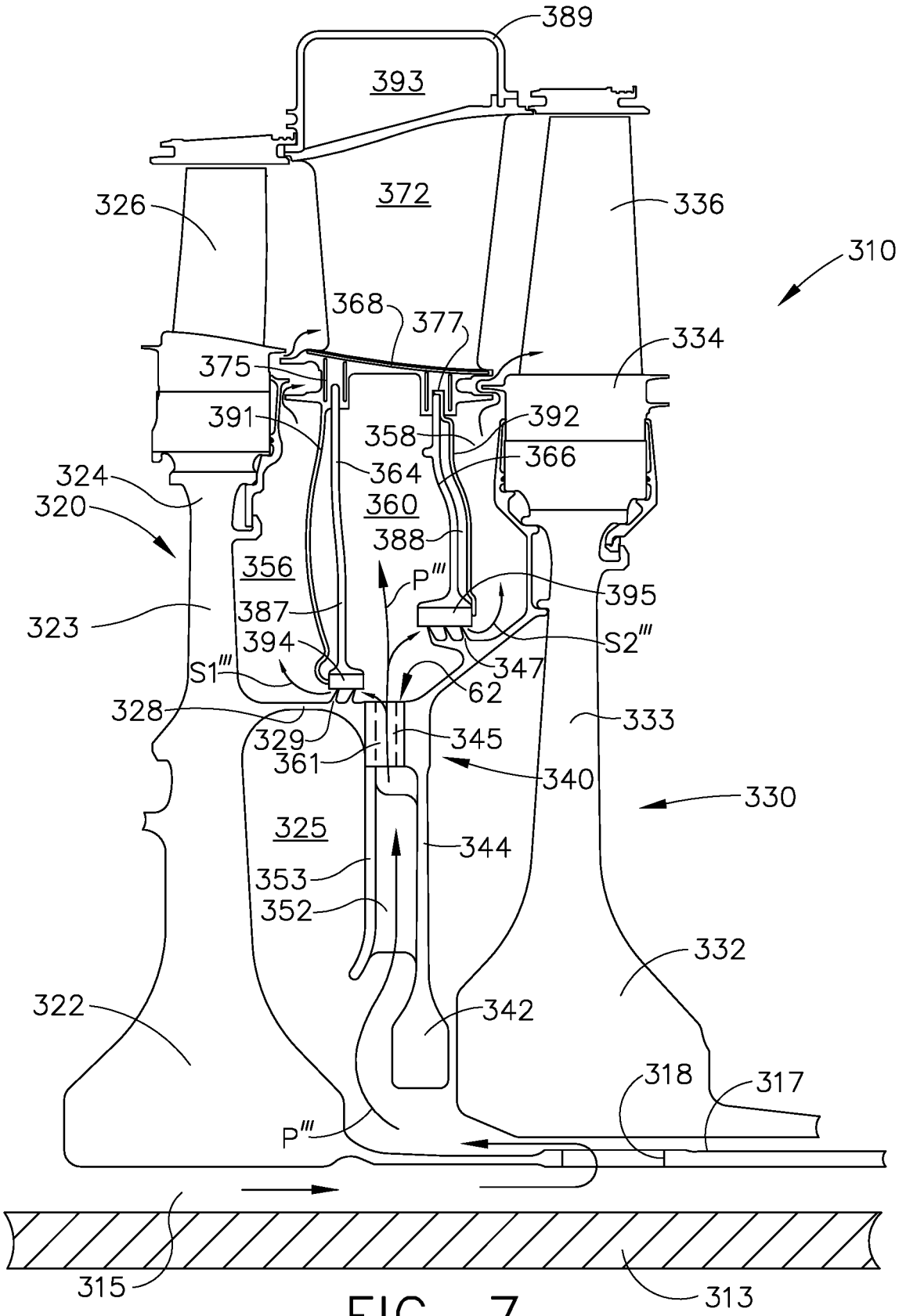
FIG. 7 is a sectional view of an interstage region that is configured to conduct flow radially outward from an air duct to a central plenum according to another alternative embodiment of the present invention.

Referring now to FIGS. 5-7, alternative embodiments are shown in those figures and described further below. Please note that each alternative embodiment is described using reference numbers in a given 100 series. Similar reference numbers in different 100 series refer to similar parts disclosed in the embodiment described above and/or another alternative embodiment.

In FIG. 5 there is shown an alternative embodiment that includes a flow circuit P' that extends from an inner chamber 125, through a plenum 160, into a pipe 180, and into an outer band plenum 193. Continuing to refer to FIG. 5, a first stage disk 120 having a plurality of first stage blades 126 extending from the outer end thereof is positioned forward of a second stage disk 130 that has a plurality of second stage blades 136 extending from an end thereof.

An aft arm 128 extends from the first disk 120 toward a forward arm 138 that extends from the second stage disk 130. A curvic 145 is defined at the junction of the aft arm 128 and the forward arm 138. Multiple passageways 161 are defined through the curvic 145 such that the chamber 125 is fluidly connected to the plenum 160. The curvic 145 is configured to mechanically link second stage disk 130 with the first stage disk 120.

An aft mid-seal disk 140 is positioned between the first stage disk 120 and a second stage disk 130. An aft seal 147 is defined on the aft mid-seal disk 140. A forward mid-seal disk 141 is positioned between the first stage disk 120 and the aft mid-seal disk 140. A forward seal 129 is defined on the forward mid-seal disk 141. It should be appreciated that the seals 129 and 147 can be configured as other types of rotating seals than shown.

The plenum 160 is defined radially outward of the curvic 145. The plenum 160 is defined by an inner boundary element 162, a forward boundary element 164, an aft boundary element 166, and an outer boundary element 168. The forward boundary element 164 is configured to separate the plenum 160 from a forward chamber 156. The aft boundary element 166 is configured to separate the plenum 160 from an aft chamber 158.

A second stage nozzle vane 172 is positioned radially outward of the plenum 160. The transfer pipe 180 is positioned such that it passes through the second stage nozzle 172. The transfer pipe 180 extends from a trumpet 182 that is positioned within the plenum 160 at one end to a diffuser 184 at another end. The diffuser 184 is positioned within a plenum 193 outward of the outer band and defined by an outer wall 189 and the nozzle vane 172. A plurality of feed holes 186 are defined within the walls of the transfer pipe 180.

In the alternative embodiment as shown in FIG. 5, the forward boundary element 164 is defined by the forward mid-seal disk 141. The aft boundary element 166 is defined by the aft mid-seal disk 140.

The primary flow circuit P' extends from chamber 125 through the passageways 161 defined in the curvic 145 and into the plenum 160. The flow circuit P' exits the plenum 160 by entering the pipe 180. A forward secondary circuit S1' is configured to conduct gas flow from the plenum 160 and into the forward chamber 156 via the forward mid-seal 129. The circuit S1' continues outwardly away from the axis 2 to maintain a positive purge flow rate sufficient to prevent high-temperature gases from entering the forward chamber 156. An aft secondary circuit S2' is configured to conduct gas flow from the plenum 160 into the aft chamber 158 via the aft mid-seal 147. The flow circuit S2' continues outwardly away from the axis 2 to maintain a positive purge flow rate sufficient to prevent high temperature gases from passing inwardly into the aft chamber 158.

In FIG. 6 there is shown another alternative embodiment that includes a flowpath P that extends from an inner chamber 225, through a plenum 260, into a pipe 280, and into an outer band plenum 293. Continuing to refer to FIG. 6, a first stage disk 220 having a plurality of first stage blades 226 extending from the outer end thereof is positioned forward of a second stage disk 230. The disk 230 has a plurality of second stage blades 236 extending from an end thereof.

An aft arm 228 extends from the first disk 220 toward a forward arm 238 that extends from the second stage disk 230. A curvic 245 is defined at the junction of the aft arm 228 and the forward arm 238. Multiple passages 261 are defined through the curvic 245 such that the chamber 225 is fluidly connected to the plenum 260. The curvic 245 is configured to mechanically link second stage disk 230 with the first stage disk 220.

A forward seal 229 is attached to the first stage disk 220. An aft seal 247 is attached to the second stage disk 230.

The plenum 260 is defined radially outward of the curvic 245. The plenum 260 is defined by an inner boundary element 262, a forward boundary element 264, an aft boundary element 266, and an outer boundary element 268. The forward boundary element 264 is configured to separate the plenum 260 from a forward chamber 256. The aft boundary element 266 is configured to separate the plenum 260 from an aft chamber 258.

A second stage nozzle vane 272 is positioned radially outward of the plenum 260. The transfer pipe 280 is positioned such that it passes through the second stage nozzle 272. The transfer pipe 280 extends from a trumpet 282 that is positioned within the plenum 260 at one end to a diffuser 284 at another end. The diffuser 284 is positioned within a plenum 293 outward of the primary flowpath outer band and is defined by an outer wall 289 and the nozzle vane 272. A plurality of feed holes 286 are defined within the walls of the transfer pipe 280.

In the embodiment shown in FIG. 6, the inner boundary 262 is defined by aft arm 228 and forward arm 238. The forward boundary element 264 is defined by the first stage disk 220 and the seal 229. The aft boundary element 266 is defined by second stage disk 230 and the seal 247. The outer boundary element is defined by the nozzle vane 272. The cooling flow circuit P" extends from chamber 225 through the passageways 261 defined in the curvic 245 and into the plenum 260.

The flow circuit P" exits the plenum 260 by entering the pipe 280. A forward secondary circuit S1" is configured to conduct gas flow from the plenum 260 and into the forward chamber 256 via the forward mid-seal 229. The flow circuit S1" continues outwardly away from the axis 2 to maintain a positive purge flow rate sufficient to prevent high-temperature gases from entering the forward chamber 256. An aft secondary circuit S2" is configured to conduct gas flow from the plenum 260 into the aft chamber 258 via the aft mid-seal 247. The circuit S2" continues outwardly away from the axis 2 to maintain a positive purge flow rate sufficient to prevent high temperature gases from passing inwardly into the aft chamber 258.

Referring now to FIG. 7, it shows another alternative embodiment that includes an interstage region 310. The interstage region 310 includes a central plenum 360 that is not fluidly connected to an outer band by a tube. The interstage region 310 is generally defined by a first stage disk 320 and a second stage disk 330. The first stage disk 320 and the second stage disk 330 are bodies of revolution. The first stage disk 320 and the second stage disk 330 in part define an annular inner chamber 325. A plurality of air ducts 315, each defined within an associated rotating tube, extends from the chamber 314 as shown in FIG. 2 to an inner chamber 325 of the interstage region 310 such that the chamber 314 and the interstage region 310 are fluidly connected. For each of the air ducts 315, an associated opening 318 is defined through a wall 317 that separates that air duct 315 from the inner chamber 325.

The first stage disk 320 includes a first stage disk bore 322 and a first stage disk web 323 that extends to a rim 324. A plurality of radially disposed first stage blades 326 extends outwardly from the rim 324. An aft arm 328, which is an annular ridge defined on the first stage disk web 323 about the axis 2, extends from the web 323 aft of the first stage disk 320. A forward mid-seal 329 is positioned at the aft edge of the aft arm 328. The forward mid-seal 329, as shown, is configured as a two-tooth labyrinth seal. The second stage disk 330 includes a bore 332, a web 333 that extends radially outward from the disk bore 332, and a rim 334. The second stage disk rim 334 is configured to support a plurality of radially disposed second stage blades 336.

A plurality of second stage nozzle vanes 372 are radially distributed outward of the central plenum 360 such that the second stage nozzle vanes 372 are aft of the first stage blades 326 and forward of the second stage blades 336. The plurality of second stage nozzle vanes 372 are supported by an inner band 373. A forward hanger 375 is defined on the inner band 373 and extends radially inward. An aft hanger 377 is defined on the inner band 373 and extends radially inward.

A forward stator plate 387 is a body of revolution that is attached to forward hanger 375. The forward stator plate 387 extends radially inward from the forward hanger 375 to a forward honeycomb block 394 attached thereto. An aft stator plate 388 is a body of revolution that is attached to the aft hanger 377. The aft stator plate 388 extends radially inward from the aft hanger 377 to an aft honeycomb block 395 attached thereto. The forward stator plate 387 extends closer to the axis 2 than does the aft stator plate 388.

A mid-seal disk 340 is positioned between the first stage disk 320 and the second stage disk 330. The mid-seal disk 340 is a body of revolution and includes a bore 342, a web 344, and a curvic 345. The curvic 345 is configured to mechanically link the mid-seal disk 340 with the first stage disk 320 via the aft arm 328 of the first stage disk 320. A plurality of curvic passageways 361 are defined through the curvic 345 between a radially inward side and a radially outward side of the curvic 345. An annular aft seal 347 is defined on the mid-seal disk 340. The seal 347, as shown, is configured as a three-tooth labyrinth seal in FIG. 1. It should be appreciated that the seals 329 and 347 can be configured as other types of rotating seals.

The forward mid-seal 329 and the aft mid-seal 347 are configured to sealingly engage the forward honeycomb block 324 and the aft honeycomb block 395 respectively and are positioned closer to the axis than conventional misdeals are. Stated another way, the method-seal disk 340 is of lower diameter than if the forward mid-seal 329 and the aft mid-seal 347 are positioned outwardly closer to the nozzle and 372. As a result, the potential leakage area across the forward to seal 329 in the aft seal 347 is lower than the potential leakage area in conventional seals.

An annular central plenum 360 is defined radially outward of the curvic 345. The central plenum 360 is defined by an inner boundary element 362, a forward boundary element 364, an aft boundary element 366, and an outer boundary element 368. A plurality of radial diffuser vanes 354 is positioned within the central plenum 360 between the forward boundary element 364 and the aft boundary element 366. The forward boundary element 364 is configured to separate the central plenum 360 from an annular forward chamber 356. The aft boundary element 366 is configured to separate the central plenum 360 from an annular aft chamber 358. A forward rotating plate 353 supports a plurality of impeller vanes 352 that are configured to prevent air from being pumped radially outward.

In the illustrated embodiment as shown in FIG. 1, the forward boundary element 364 is defined by the forward stator plate 387. A forward heatshield 391 is positioned forward of the stator plate 387. The aft boundary element 366 is defined by the aft stator plate 388. A heatshield 392 is positioned aft of the stator plate 388. It should be appreciated that the forward stator plate 387, the forward heatshield 391, the aft stator plate 388, and the heatshield 392 are all bodies of revolution.

Flow circuits between the air duct 315 that extend outwardly through the interstage region 310 will now be described. A primary flow circuit P''' extends from the air duct 315 through the opening 318 and into the chamber 325. Once in the chamber 325 the primary flow circuit P''' passes through the plurality of impeller vanes 352 and through the plurality of curvic passageways 361 defined through the curvic 345. After passing through the curvic passageways 361, the flow circuit P''' enters the central plenum 360. The flow circuit P''' exits the central plenum 360 through various split line leakage along the inner band 373.

A forward secondary flow circuit S1''' is configured to conduct gas flow from the plenum 360 to the forward chamber 356 via the forward mid-seal 329. The flow circuit S1 continues radially outward away from the axis 2 to maintain a positive purge flow rate preventing high-temperature gases from entering the forward chamber 356.

An aft secondary circuit S2''' is configured to conduct gas flow from the central plenum 360 into the aft chamber 358 via the aft mid-seal 347. The flow circuit S2''' continues radially outward away from the axis 2 to maintain a positive purge flow rate preventing high temperature gases from passing inwardly into the aft chamber 358.

The gas turbine engine having a secondary cooling flow circuit defined within an interstage region from an air duct defined through the bore to the outer bands of the high-pressure turbine section of the engine has advantages over the prior art. In particular, the engine described above does not require piping from intermediate (non-compressor-discharge) stages within the compressor such as stage 7 to the outer band of the high-pressure turbine. In this way the engine described above weighs less and has more space available for structure other than piping in conventional engines, while still benefiting from the use of lower-stage compressor bleed gas (non-compressor-discharge).

The foregoing has described a structure and a method for directing gases outwardly from the core passageway to cool the outer band of a gas turbine engine without additional piping. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A gas turbine engine having a turbine interstage region that is configured to conduct bore bleed air outwardly, the interstage region comprising:
- a central plenum; and
- a first mid-seal disposed on a first mid-seal disk and a second mid-seal disposed on a second mid-seal disk,
- a plurality of radial diffuser vanes positioned in the central plenum,
- wherein the central plenum is fluidly connected to bore bleed air by a flow circuit that passes between the first mid-seal and the second mid-seal.

2. A gas turbine engine having an interstage region that is configured to conduct bore bleed air to an outer band of a turbine section, the engine comprising:
- a central plenum; and
- a first mid-seal disposed on an aft side of a first mid-seal disk and a second mid-seal disposed on a forward side of a second mid-seal disk,
- wherein the first mid-seal and the second mid-seal are at different radial distances from an axis of the engine, and
- wherein a flowpath of the bore bleed air passes through a space formed between the first mid-seal and the second mid-seal.

3. The gas turbine engine according to claim 2,
- wherein the first mid-seal disk is a forward mid-seal disk, and the second mid-seal disk is an aft mid-seal disk, and
- wherein the flow circuit passes through a space formed between the forward mid-seal disk the aft mid-seal disk in an axial direction.

4. The gas turbine engine according to claim 2, wherein the first and second mid-seal disks are configured to rotate.

5. The gas turbine engine according to claim 2, wherein the first mid-seal disk is coupled to an aft side of a first disk for a first plurality of blades, and the second mid-seal disk is coupled to a forward side of a second disk for a second plurality of blades.

6. The gas turbine engine according to claim 2,
- a nozzle vane positioned radially inward of the outer band,
- wherein the central plenum is defined in part by a curvic positioned radially inward from the nozzle vane.

7. A gas turbine engine having an interstage region that is configured to conduct bore bleed air to an outer band of a turbine section, the engine comprising:
- a central plenum;
- a first mid-seal disposed on a first mid-seal disk and a second mid-seal disposed on a second mid-seal disk; and
- a nozzle vane positioned radially inward of the outer band,
- wherein the first mid-seal and the second mid-seal are at different radial distances from an axis of the engine,
- wherein the central plenum is defined in part by a curvic positioned radially inward from the nozzle vane, and
- wherein a plurality of radial diffuser vanes is located radially outward of the curvic.

8. The gas turbine engine according to claim 7, wherein a flow circuit flows radially outward from an air duct, through the curvic, the plurality of radial diffuser vanes, and a transfer pipe to an outer band plenum radially outward to the outer band.

9. A gas turbine engine having a turbine interstage region that is configured to conduct bore bleed air outwardly, the interstage region comprising:

a central plenum;

a first mid-seal disk;

a forward boundary element disposed on an aft side of the first mid-seal disk;

a second mid-seal disk;

an aft boundary element disposed on a forward side of the second mid-seal disk;

a first mid-seal disposed on the forward boundary element; and a second mid-seal disposed on the aft boundary element, wherein a space is formed between the forward boundary element and the aft boundary element such that the forward boundary element does not contact the aft boundary element, and wherein the central plenum is fluidly connected to bore bleed air by a flow circuit that passes through the space between the forward boundary element and the aft boundary element and that passes between the first mid-seal and the second mid-seal.

10. The gas turbine engine according to claim 9, comprising:

an outer band; and wherein the outer band is fluidly connected to bore bleed air by a flow circuit that passes between the first mid-seal and the second mid-seal.

11. The gas turbine engine according to claim 10, comprising:

an inner boundary element; and an outer boundary element, wherein the inner boundary element includes a curvic.

12. The gas turbine engine according to claim 11, comprising:

passageways formed through the curvic; and wherein the passageways fluidly connect the central plenum with an inner chamber.

13. The gas turbine engine according to claim 12, comprising:

an outer band plenum;

a nozzle vane positioned radially inward of the outer band plenum; and a pipe that is positioned through the nozzle vane and fluidly connects the central plenum with the outer band plenum.

14. The gas turbine engine according to claim 13, wherein the pipe has a plurality of feed holes defined therein.

15. The gas turbine engine according to claim 11, wherein the forward boundary element is comprised of a forward stator plate and the aft boundary element is comprised of an aft stator plate.

16. The gas turbine engine according to claim 9, wherein the first mid-seal disk is a forward mid-seal disk, and the second mid-seal disk is an aft mid-seal disk, and wherein a flow circuit passes through a space formed between the forward mid-seal disk the aft mid-seal disk in an axial direction.

17. The gas turbine engine according to claim 9, wherein the first and second mid-seal disks are configured to rotate.

18. The gas turbine engine according to claim 9, wherein the first mid-seal disk is coupled to an aft side of a first disk for a first plurality of blades, and the second mid-seal disk is coupled to a forward side of a second disk for a second plurality of blades.

* * * * *